US006478693B2

(12) United States Patent
Matsunaga et al.

(10) Patent No.: US 6,478,693 B2
(45) Date of Patent: Nov. 12, 2002

(54) GOLF CLUB HEAD

(75) Inventors: Hideo Matsunaga, Saitama (JP); Masashi Nishitani, Saitama (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 09/775,612

(22) Filed: Feb. 5, 2001

(65) Prior Publication Data

US 2001/0012804 A1 Aug. 9, 2001

(30) Foreign Application Priority Data

Feb. 4, 2000 (JP) ..... 2000-028042
Jan. 16, 2001 (JP) ..... 2001-007447

(51) Int. Cl.[7] ..... A63B 53/04
(52) U.S. Cl. ..... 473/345
(58) Field of Search ..... 473/345, 329, 473/342, 330, 331, 346, 347, 348, 349, 350

(56) References Cited

U.S. PATENT DOCUMENTS 1,567,248 A * 12/1925 Dahlman ..... 473/342
5,776,011 A * 7/1998 Su et al. ..... 473/345

FOREIGN PATENT DOCUMENTS

JP 9-168613 6/1997

* cited by examiner

*Primary Examiner*—Paul T. Sewell
*Assistant Examiner*—M. Chambers
(74) *Attorney, Agent, or Firm*—Sughrue Mion, PLLC

(57) ABSTRACT

In a golf club head with a loft angle in a range of from 5 to 30 degrees, the golf club head comprises a metal body having a hollow portion and having a face portion, a thick portion is formed on the back surface of the face portion, when counted from behind the face portion to the face portion side, the thick portion has N steps (N≧2) so that a centroid of a cut surface of the first step is distanced by 1 mm or more from a centroid of the face surface, and a centroid of a cut surface of the Nth step is distanced by 1 mm or more from a centroid of a cut surface of the N-1th step. Incidentally, the cut surface of each of the steps is defined by cutting provisionally the face portion at each of the steps in parallel to a plane touching with the face surface at a face center

14 Claims, 3 Drawing Sheets

GOLF CLUB HEAD

BACKGROUND OF THE INVENTION

1. Field of the Invention

The present invention relates to setting of the thickness of a face surface of a golf club head.

2. Description of the Related Art

A low specific gravity and high strength metal material has been used for a wood club head in recent years. Size of the wood club head has been increased year by year. Therefore, the area of the face of the wood club head has been increased while the thickness thereof has been reduced. Moreover, a proposal to use flexure of the face at impact to thereby enhance carry of a hit ball has been made recently. The flexure of the face at impact has been increased as largely as possible to aim at increase in repulsion force of the face. Hence, the face has been required to have high durability without reduction in flexure at impact.

To satisfy such requirement, a proposal has been made for a face structure in which the thickness of a circumferential edge portion of the face is reduced to increase repulsion force while the thickness of a center portion of the face where hitting points are concentrated is increased stepwise by swelling back of the face toward the face center to improve durability. For example, JP-A-9-168613 has disclosed a face structure according to the proposal.

In the aforementioned proposal, however, a largest quantity of deformation, that is, maximum flexure of the face backward the head at impact occurs in a centroid of the face surface. Hence, a hill-shaped thick portion with the centroid as its peak is provided on the back of the face, or a hill-shaped thick portion with the face center, which is a point of intersection between a bisector dividing the distance from a toe to a heel into two and a bisector dividing the distance from a leading edge to a top edge into two on the face surface, as its peak is provided on the back side of the face. Therefore, a considerable reinforcing effect could be obtained if a ball was always hit on the center such as the centroid, the face center, or the like. There was however a problem that a sufficient reinforcing effect could not be obtained if a ball-hitting point on the face surface at impact was shifted from the center position (as called off-center impact).

Moreover, in the aforementioned related-art head, when off-center impact was made, the problem to be considered was that the hitting point did not coincide with the position taking the largest quantity of flexure so that sufficient repulsion force could not be obtained.

Upon such circumstances, therefore, an object of the present invention is to provide a golf club head which fulfills large repulsion force and high durability to facilitate increase in sweet area, increase in size and reduction in thickness of the head even in the case where off-center impact is made.

SUMMARY OF THE INVENTION

In order to achieve the above object, a golf club head according to a first aspect of the invention is a golf club head with a loft angle in a range of from 5 to 30 degrees, the wood club head comprising a metal body having a hollow portion and a face portion, wherein a thick portion is formed on the back surface of the face portion, the thick portion has N steps ($N \geqq 2$, preferably $N \geqq 3$), when counted from behind the face portion to the face portion side, so that a center of the face portion including the first step is the thickest and the thick portion becomes gradually thin toward the peripheral portion thereof;

a centroid of a cut surface of the first step is distanced by 1 mm or more from a centroid of the face surface; and a centroid of a cut surface of the Nth step is distanced by 1 mm or more from a centroid of a cut surface of the N−1th step. Incidentally, the cut surface of each of the steps is defined by cutting provisionally the face portion at each of the steps in parallel to a plane touching with the face surface at a face center;

In the golf club head according to the invention, the center portion of the face is reinforced with the thick portion provided on the back of the face. Hence, deterioration of durability of the face due to large flexure in a place near the centroid of the face surface is prevented.

Moreover, the thick portion is mounted a hill-shaped on the back of the face. Hence, reinforcement can be made in accordance with distribution of the magnitude of flexure of the face in the face surface at impact. That is, the face thickness in the center region of the face surface is set to be very large in accordance with large flexure in the center region of the face surface, and the face thickness in the peripheral region of the face surface is set to be very small in accordance with small flexure in the peripheral region of the face surface.

The thick portion is formed on the back surface of the face portion, and the thick portion has N steps ($N \geqq 2$), when counted from behind the face portion to the face portion side, so that a center of the face portion including the first step is the thickest and the thick portion becomes gradually thin toward the peripheral portion thereof. Moreover, the centroid of the cut surface of the first step is distanced by 1 mm or more from the centroid of the face surface and the centroid of the cut surface of the Nth step is distanced by 1 mm or more from the centroid of the cut surface of the N−1th step. That is, the centroids of adjacent ones of the each cut surface are displaced suitably from each other. Hence, the magnitude of the face flexure taking local maximum at the centroid of the face surface as that in the related art is reduced to obtain a flat distribution leveled in a neighbor of the centroid of the face surface. Moreover, the thick portion can be formed and disposed so that the face surface is thickened most in accordance with the region in which hitting points are distributed. Hence, durability of the face surface can be improved efficiently even in the case where off-center impact in which the hitting point is displaced from the face center or from the centroid of the face surface occurs frequently. Even in the case where the head size will be increased more than that at the present time, the present invention can sufficiently cope with the increase of the head size.

Moreover, in the present invention, the position of the centroid of each of the steps constituting the face surface and the thick portion can be calculated in the condition that the face surface is frontally viewed in a direction perpendicular to a plane touching the face center while the head has a regular loft angle and a regular lie angle.

Incidentally, the "centroid" or "figure center" used in the present invention is defined in known books of strength of materials and is calculated by use of the following expression in terms of distance (e) from an optional axis to the centroid, which distance (e) is a value obtained by dividing sectional primary moment (I) with respect to arbitrary axis by the total area (A).

$$e=I/A$$

Where I is a value obtained by $I=\int y\,dA$, and y is a distance from the axis to an infinitesimal area dA.

The golf club head according to the present invention is formed to have a loft angle in a range of from 5 to 30 degrees. If the loft angle is smaller than 5 degrees, it is difficult to enhance carry because even a professional golf player can hardly lift up a ball. If the loft angle is larger than 30 degrees, there is a considerable problem in practical use because the ball is typically flown too high even in the case where the head is used as a fairway club head.

Moreover, in the present invention, when respective steps constituting thick portion are provisionally cut in parallel to a plane which is a tangent touching the face surface at the face center, distance between the centroid of the cut surface of the first step and the centroid of the face surface and distance between the centroid of the cut surface of the N−1th step and the centroid of the cut surface of the Nth step need to be in a range of 1 mm to 25% of the face length. The both distances are preferably not less than 3 mm, more preferably 5 mm, and are preferably not more than 20% of the face length. If the distance is smaller than 1 mm, peaks of flexure distribution cannot be averaged so that region taking maximum flexure cannot be widened. This is because the maximum flexure points of respective flat plates overlap one point upon the assumption that the thick portion is formed of a laminate of the flat plates with suitable thicknesses. On the other hand, if the distance is too large, the peaks of the flexure distribution in the center region of the face cannot be averaged so that the region taking the maximum flexure cannot be widened. This is because the high bending rigidity portion of the thick portion becomes far from the centroid of the face surface so that the effect to suppress flexure in the centroid of the face surface runs short. Hence, according to the result of the inventor's numerical analysis, it is preferable that the maximum values of the distances are not larger than 25% of the face length, preferably 20% of the face length (the horizontal distance from the toe end of the face surface to the heel end thereof). Incidentally, if the maximum values of the distances defined by only the face length are unclear, the maximum values of the distances need to be not more than 25 mm at most, preferably not more than 20 mm.

It is preferable that the thickness of each of the steps in the thick portion is selected to be in a range of from 0.1 to 1.0 mm. More preferably, the thickness of each step is in a range of from 0.2 to 0.8 mm. Further more preferably, the thickness of each step is in a range of from 0.3 to 0.6 mm. This is for the purpose of providing clear steps in the thick portion to thereby facilitate setting an arrangement of the centers of figure of the steps in production. If each of the steps is smaller than 0.1 mm, the steps are too small to set the cut surface in each of the steps. If each of the steps is larger than 1.0 mm, there is a risk that the total thickness of the thick portion becomes too large.

In relation to a total thickness from the face surface to top surface of each step, preferably, the maximum of the total thickness (the thickest position) is not more than 5.0 mm, and the minimum thereof (the thinnest position) is not less than 1.0 mm. More preferably, the maximum of the total thickness (the thickest position) is not more than 3.5 mm, and the minimum thereof (the thinnest position) is not less than 1.5 mm. If the maximum thereof is more than 5.0 mm, an effect of the reinforcement is not only increased, but it also goes against a requirement of weight saving. If the minimum thereof is less than 1.0 mm, an effect of the thick portion is not obtained sufficiently. Since the number of the steps are limited by the thickness of the thick portion and the thickness of each step, the maximum of the number of steps are not limited specifically.

BREIF DESCRIPTION OF THE DRAWINGS

DETAILED DESCRIPTION OF THE PREFERRED EMBODIMENT

An embodiment of the present invention will be described below with reference to FIGS. 1 through 3.

Figure 1:
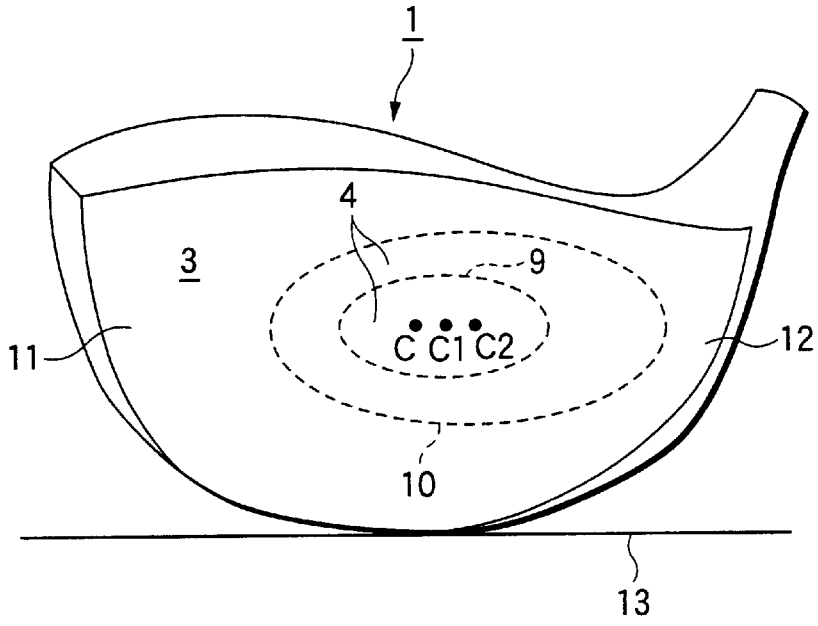
FIG. 1 is a front view of a face of a head according to an embodiment.

FIG. 1 is a front view of a wood club head 1 according to an embodiment of the present invention when the club head 1 is viewed in a direction perpendicular to a face surface 3 at a face center in an addressing posture with a regular lie angle and a regular loft angle.

In this embodiment, the head 1 is provided as a driver head made of a titanium alloy with a volume of 290 ml, a loft angle of 11 degrees and a lie angle of 57 degrees.

Figure 2:
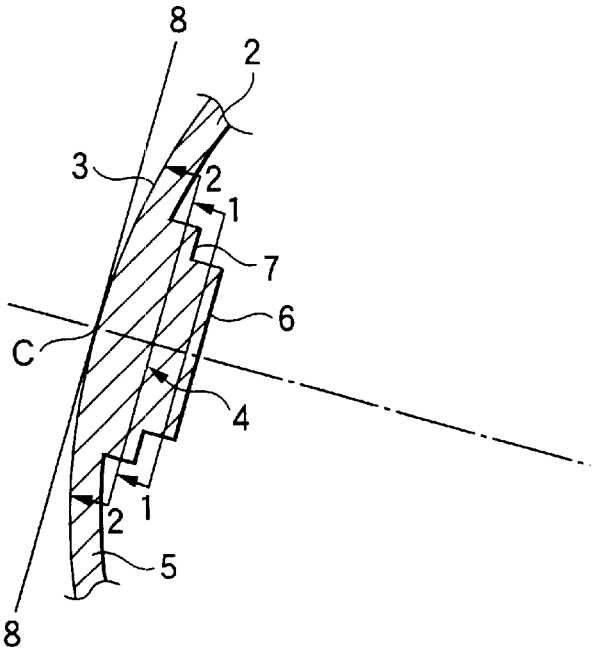
FIG. 2 is a partly cutaway sectional view of the face of the head according to the embodiment.

In FIGS. 1 and 2, a thick portion 4 shaped like a two steps hill when counted f rom behind a face 2 to the face surface 3 is formed on the back of the face 2 of the head 1 in this embodiment. That is, the thick portion 4 is made of a titanium alloy and shaped as if two elliptical plates different in size are laminated as two steps.

A thickness from the face surface 3 to a top surface of a first step 6 of the thick portion 4 is 3.5 mm. On the other hand, a thickness from the face surface 3 to a top surface of a second step 7 is 3.0 mm. The thickness of the face 2 is 2.5 mm. Accordingly, the first step 6 and second step 7 of the thick portion 4 have a thickness of 0.5 mm, respectively.

If the head is provisionally cut at the respective steps of the thick portion 4 in parallel to a plane 8 which is a tangent touching the face surface 3 at the face center C, a cut surface 9 of the first step (section taken along the line 1—1 in FIG. 2) is shaped like an ellipse having a major axis parallel to a horizontal plane 13 in a direction of from a toe 11 of the head to a heel 12 thereof. A figure center C1 of the ellipse is distanced by 6 mm from the figure center C of the face surface in a direction of the heel 12 as shown in FIG. 1. Incidentally, in this embodiment, the figure center C of the face surface itself except the thick portion is made coincident with the face center C.

A cut surface of a second step 10 (section taken along the line 2—2 in FIG. 2) is also shaped like an ellipse. A figure center C2 of a second-step ellipse is distanced by 5 mm from the figure center C1 of the first-step ellipse and is distanced by 11 mm from the figure center C of the face surface.

As a result, it is to be understood clearly from the front view of FIG. 1 showing the thickness distribution of the thick portion 4 that the bending rigidity of the thick portion 4 is formed so that the bending rigidity is changed dramatically from the figure center C of the face surface to the toe 11 while the bending rigidity is changed gradually from the figure center C of the face surface to the heel 12.

Figure 3:
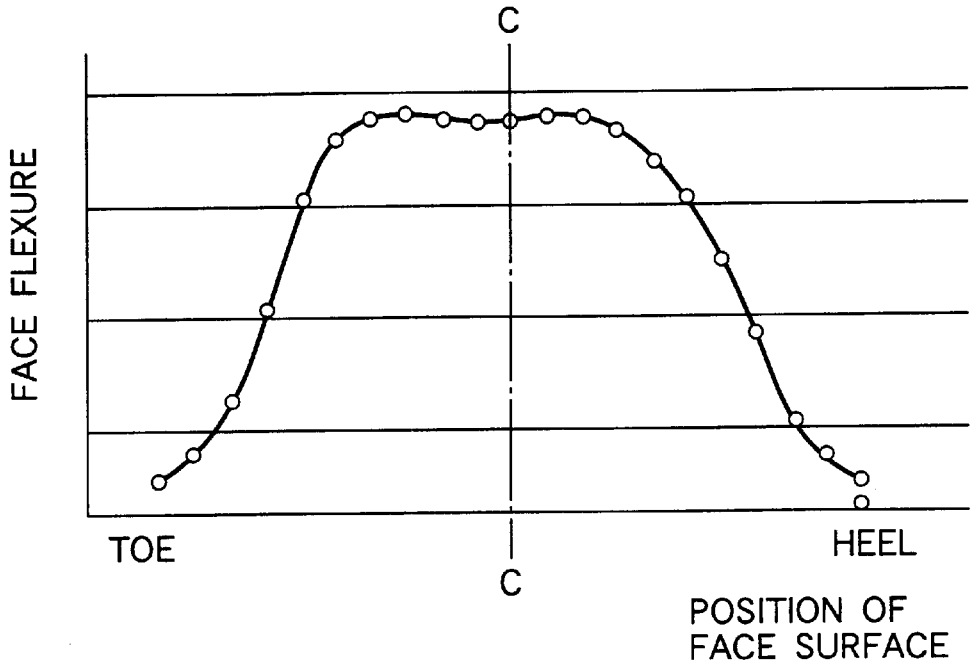
FIG. 3 is a graph showing flexure distribution of the face of the head according to the embodiment.

The flexure distribution in a direction from the toe 11 of the face 2 to the heel 12 thereof is calculated by computer simulation as shown in FIG. 3. It is apparent from FIG. 3 that flexure of the center portion of the face 2 is averaged so that the maximum flexure region is widened. That is, the region, in which large repulsion force based on large flexure is obtained, is widened so that a so-called enlarged sweet area can be obtained. Incidentally, in this embodiment, the sweet area (equivalent to the maximum flexure region) is enlarged from the figure center C of the face surface toward the toe 11 due to the bending rigidity distribution.

Hence, in this embodiment, even if the hitting point is shifted by 20 mm from the figure center C of the face surface (that is, from the face center C) toward the toe side to do off-center impact, since the hitting point is still within the sweet area of the face surface 3, hitting excellent in carry and in directivity can be obtained.

Figure 4:
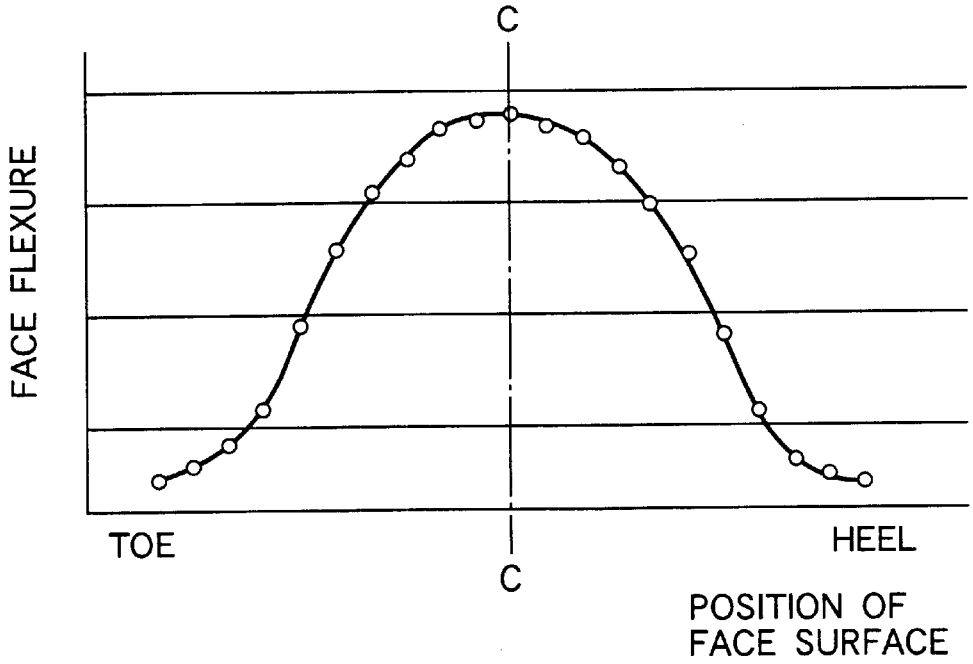
FIG. 4 is a graph showing the flexure distribution of a face of a head according to a comparative example.

On the other hand, a related-art driver head which is made of the same material with the same volume and the same shape as in the embodiment except that the thick portion 4 is not provided on the back of the face is prepared as a comparative example. Flexure distribution of the comparative example is calculated in the same condition as that in the embodiment. As a result, the flexure distribution with local peaks at the figure center C of the face is obtained as shown in FIG. 4. That is, the sweet area of the comparative example is limited to a narrow region near the figure center C of the face surface, that is, a narrow region near the face center C.

Hence, if off-center impact is made in the aforementioned manner, large repulsion force cannot be obtained so that both carry performance and directivity at impact are deteriorated.

In the embodiment, the thick portion 4 has a rectangle shape in the sectional view as shown in FIG. 2. However, if the first step 6 and second step 7 are formed in a trapezial shape,a side surface of the thick portion 4 can be formed as a continuous shape without any steps. In this case, the thick portion 4 does not have definite steps. However, the steps are formed in order to facilitate setting the arrangement of the position of the centroid in the manufacturing as the above described, and thus this case does not depart from the purpose of the invention. Consequently, in case that the steps are not definite, supposing to divide equally the thick portion 4 up and down, the thick portion 4 can be considered as two steps.

Figure 5:
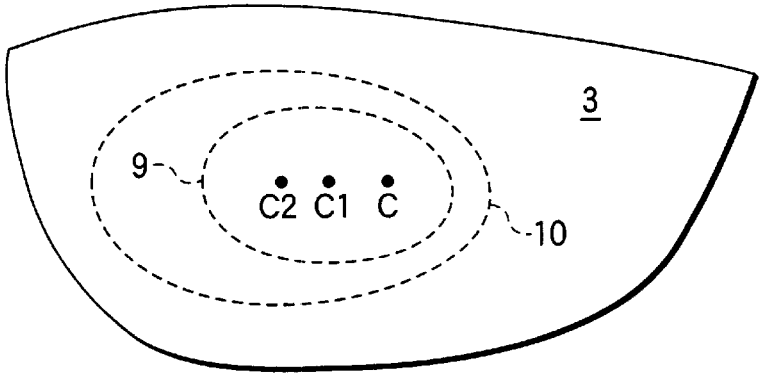
FIG. 5 is a front view of a face of a head according to a first variation of another embodiment.
Figure 6:
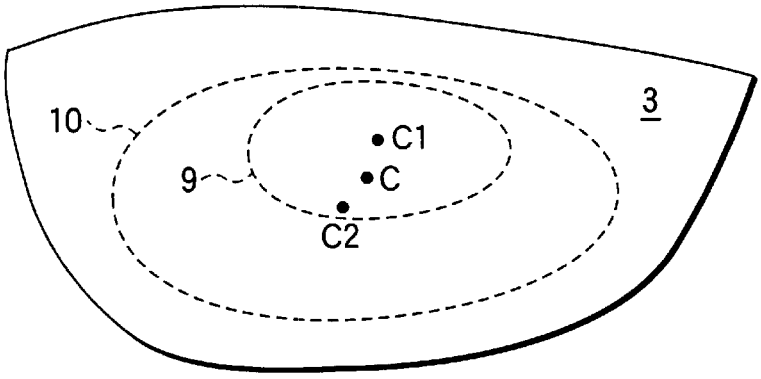
FIG. 6 is a front view of a face of a head according to a second variation of the another embodiment.
Figure 7:
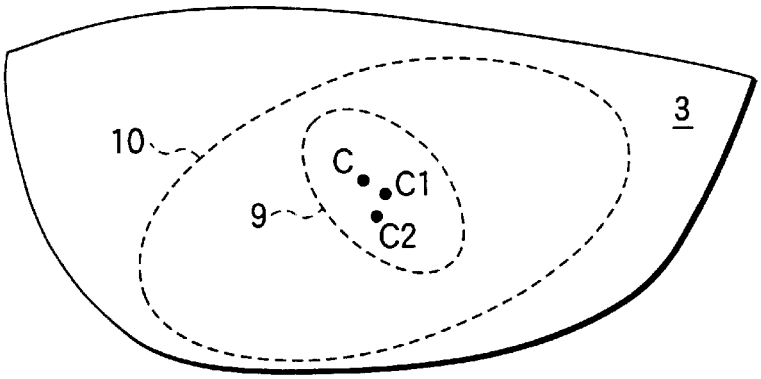
FIG. 7 is a front view of a face of a head according to a third variation of the another embodiment.

In addition, the shape of the thick portion 4 can be modified variously. When, for example, the thick portion 4 is composed of two steps, the shape of the cut surface 9 or 10 and the position of the centroid thereof may be configured as shown in any one of FIGS. 5 to 7.

In the golf club head according to the present invention, the thick portion for reinforcing the face is provided on the back of the face. Moreover, the centroid of each cut surface parallel to a plane which is a tangent touching the thick portion at the face center is set to be distanced from the centroid of the face surface. Moreover, the positions of the centers of figure of the cut surfaces in the respective positions in the direction of the thickness of the thick portion are set to be different from one another. Hence, the magnitude of the maximum flexure of the face surface at ball hitting can be suppressed as well as the maximum flexure region can be widened so that the sweet area of the face surface can be enlarged.

Hence, both carry and directivity at impact can be prevented from being deteriorated when off-center impact is made.

Further, even in case where there is a request to increase the head volume, for example, to 300 ml or more in order to enhance the carry, the maximum flexure value of the face can be suppressed according to the present invention. Hence, the face can be set to be further thinner, so that the weight of the head can be suppressed.

What is claimed is:

1. A golf club head with a loft angle in a range of from 5 to 30 degrees, the golf club head comprising a metal body having a hollow portion and a face portion, wherein a thick portion is formed on the back surface of the face portion, the thick portion has N steps ($N \geqq 2$) so that a center of the face portion including the first step is the thickest and the thick portion becoms gradually thin toward the peripheral portion thereof;

a distance between a centroid of a cut surface of the first step and a centroid of the face surface, and a distance between a centroid of a cut surface of the Nth step and a centroid of a cut surface of the N−1th step are in a range of from 1 mm to 25% of a face length.

2. The golf club head according to claim 1, wherein each of the steps has a thickness in a range of from 0.1 to 1.0 $\mu$m.

3. The golf club head according to claim 1, wherein each of the steps has a thickness in a range of from 0.3 mm to 0.8 mm.

4. The golf club head according to claim 1, wherein each of the steps has a thickness in a range of from 0.4 mm to 0.7 mm.

5. The golf club head according to claim 1, wherein the each of the distances is in a range of from 3 mm to 25% of the face length.

6. The golf club head according to claim 1, wherein the each of the distances is in a range of from 5 mm to 25% of the face length.

7. The golf club head according to claim 1, wherein the each of the distances is in a range of from 1 mm to 20% of the face length.

8. The golf club head according to claim 1, wherein the each of the distances is in a range of from 1 mm to 25 mm.

9. The golf club head according to claim 1, wherein the each of the distances is in a range of from 1 mm to 20 mm.

10. The golf club head according to claim 1, wherein the thickness of each steps of the thick portion is in a range of from 0.1 mm to 1.0 mm.

11. The golf club head according to claim 1, wherein the thickness of each steps of the thick portion is in a range of from 0.2 mm to 0.8 mm.

12. The golf club head according to claim 1, wherein a thickness of each step of the thick portion is in a range of from 0.3 mm to 0.6 mm.

13. The golf club head according to claim 1, wherein a total thickness from the face surface to a top surface of each step is in a range of from 1.0 mm to 5.0 mm.

14. The golf club head according to claim 1, wherein a total thickness from the face surface to a top surface of each step is in a range of from 1.5 mm to 3.5 mm.

* * * * *